United States Patent [19]

Kelly

[11] 4,450,612

[45] May 29, 1984

[54] SWAGING APPARATUS FOR RADIALLY EXPANDING TUBES TO FORM JOINTS

[75] Inventor: John W. Kelly, Burbank, Calif.

[73] Assignee: Haskel, Inc., Burbank, Calif.

[21] Appl. No.: 314,213

[22] Filed: Oct. 23, 1981

Related U.S. Application Data

[63] Continuation-in-part of Ser. No. 133,010, Mar. 24, 1980, Pat. No. 4,359,889, and a continuation of Ser. No. 218,431, Dec. 19, 1980.

[51] Int. Cl.[3] ..... B21D 22/00

[52] U.S. Cl. ..... 72/62; 29/157.3 C; 29/421 R; 29/157.4

[58] Field of Search ..... 29/421 R, 157.3 C, 157.3 H, 29/157.3 B, 157.3 R, 727; 72/62

[56] References Cited

U.S. PATENT DOCUMENTS

| | | | |
|---|---|---|---|
| 2,272,811 | 2/1942 | Nathan | 285/110 X |
| 2,460,580 | 2/1949 | Huber . | |
| 2,479,702 | 8/1949 | Rood . | |
| 2,508,286 | 5/1950 | Otis | 277/116.6 X |
| 2,903,310 | 9/1959 | Hill | 277/188 A X |
| 3,602,520 | 8/1971 | Wallis | 277/27 |
| 3,738,665 | 6/1973 | Bilco | 272/27 X |
| 3,977,068 | 8/1976 | Krips | 72/62 |
| 3,979,810 | 9/1976 | Krips et al. | 29/727 |
| 3,982,765 | 9/1976 | Fickelscher | 277/53 |
| 4,069,573 | 1/1978 | Rogers, Jr. | 29/157.3 C |
| 4,123,068 | 10/1978 | Gordon | 277/27 |
| 4,125,937 | 11/1978 | Brown et al. | 72/62 |
| 4,169,605 | 10/1979 | Nishimoto | 277/188 A |

OTHER PUBLICATIONS

"Hydraulic Expansion System Lead-Free Tube-to--Tube Sheet Joints", Oct. '78, *Energy Management.*

*Primary Examiner*—Leon Gilden

*Attorney, Agent, or Firm*—Pretty, Schroeder, Brueggemann & Clark

[57] ABSTRACT

A swaging apparatus for expanding a tube radially to form a joint, the apparatus including a mandrel for insertion in the tube. A working fluid is supplied through the mandrel to apply hydraulic pressure to the tube. The mandrel carries a pair of oppositely directed ramps, and a pair of seal combinations that are movable axially along the ramps. The seal combinations define the ends of an annular volume within which the pressurized fluid flows between the mandrel and the tube, each seal combination including a softer primary seal, which may be an O-ring, and a harder backup seal. Positioning sleeves that are axially slidable on the mandrel prevent angular movement of the backup seals relative to the longitudinal axis of the mandrel, thereby maintaining a uniform circumferential extrusion gap between the mandrel and the tube when pressure is applied. When the mandrel is being inserted, the seals are disposed at the smaller ends of the ramps so as to minimize frictional resistance to the insertion, the outer primary seal being resiliently urged inwardly by the corresponding positioning sleeve. The seals are returned to the large ends of the ramps by the application of the hydraulic pressure.

32 Claims, 5 Drawing Figures

SWAGING APPARATUS FOR RADIALLY EXPANDING TUBES TO FORM JOINTS

RELATED APPLICATIONS

This is a continuation-in-part of the inventor's earlier filed application entitled SELF-CENTERING SEAL FOR USE IN HYDRAULICALLY EXPANDING TUBES, Ser. No. 133,010, now U.S. Pat. No. 4,359,889 filed on Mar. 24, 1980, and is a continuation of the inventor's application entitled APPARATUS AND METHOD FOR HYDRAULICALLY FORMING JOINTS BETWEEN TUBES AND TUBE SHEETS, Ser. No. 218,431 filed Dec. 19, 1980.

FIELD OF THE INVENTION

The present invention relates to the radial expansion of tubes to form joints and, more particularly, to the use of hydraulic swaging forces to produce such expansion.

BACKGROUND OF THE INVENTION

There are a variety of situations in which it is desired to expand a metal tube radially to form a tight, leak-proof joint. For example, large heat exchangers, particularly the type used as steam generators in nuclear power plants, often employ a tube sheet, which is a metal plate several feet in thickness through which hundreds of stainless steel or carbon steel tubes must pass. The tube sheet is fabricated with through bores of a suitable diameter in which the tubes are inserted. The tubes are then expanded against the sides of the bores by plastic deformation to seal the small crevices that would otherwise exist around the tubes. If these crevices were allowed to remain, they could collect corrosive agents, and would, therefore, decrease the predictable life-expectancy of the equipment.

Older techniques for expanding the tubes to form the desired leak-proof joints relied upon roller swaging. However, mechanical rolling of the interior surface of the tube causes a decrease in the thickness of the tube wall. In addition, roller swaging is a time-consuming process and it is sometimes difficult or impossible to obtain the swaging pressures desired. The use of rollers imposes a minimum dimension on the inside diameter of the tube in relation to the tube wall thickness, since it must be possible to insert rollers of suitable strength and rigidity.

More recently, superior tube and tube sheet joints have been formed by hydraulic swaging. In accordance with this technique, a mandrel is inserted in the tube and a highly pressurized working fluid is introduced through the mandrel into a small annular space between the mandrel and the tube. The fluid is axially confined between seals to apply outwardly directed radial pressure to the tube wall. O-rings employed in this environment must have a sufficient diameter and rigidity to effectively confine the hydraulic fluid in the desired manner. When an O-ring of suitable size and properties is inserted in a tube it offers very high frictional resistance, binding against the interior tube surface. Insertion of the mandrel is therefore difficult and time-consuming. Remembering that large numbers of tubes are often installed in a single tube sheet, the difficulties attributable to frictional O-ring resistance to mandrel insertion is a major factor bearing upon the efficiency and effectiveness of the hydraulic swaging techniques that have been employed.

In the case of high pressure applications, it is desirable to use O-rings in combination with backup seals made of a more rigid but still elastically deformable material such as polyurethane. The O-ring forms the primary seal of each seal combination and interfaces directly with the working fluid.

It is necessary to select a material for the backup member that has the necessary hardness and elasticity, but does not deform plastically under high pressure. When plastic deformation takes place, it is often because the annular space between the mandrel and the tube is too large, permitting a portion of the backup member to be extruded into that space. For this reason the space between the mandrel and the tube is referred herein as an "extrusion gap."

It is generally possible, working with tolerances that are acceptable in this type of apparatus, to maintain the extrusion gap within satisfactory dimensional limits, provided that the gap is substantially uniform about the circumference of the mandrel. However, the mandrel tends to be positioned along the bottom surface of the tube, thus producing a gap of double thickness at the top of the mandrel. It is in this area of double thickness that plastic deformation of the backup member is generally found to occur.

The purpose of the present invention is to provide a new and improved swaging apparatus that overcomes the problems discussed above. One objective of the invention is thus to provide a swaging apparatus for tubes in which the resistance offered by the seals as the mandrel is inserted in the tube is greatly reduced, although the effectiveness of the seals is not diminished. Another objective is to provide an improved sealing arrangement that causes the extrusion gap to be substantially uniform, thereby minimizing problems of plastic deformation of sealing members.

SUMMARY OF THE INVENTION

The present invention accomplishes the above objectives. It includes a mandrel to be positioned axially within a tube to be expanded and at least one seal combination encircling the mandrel that is compressed axially and expanded radially upon the application of hydraulic pressure thereto by a working fluid. Each seal combination includes a softer primary seal, such as an O-ring, and a harder but still elastically deformable backup seal, which can be made of polyurethane. A positioning means is provided for preventing angular movement of the backup seal relative to the longitudinal axis of the mandrel, thereby forcing the backup seal to assume a radially centered position within the tube as it expands. In this way, a substantially uniform circumferential extrusion gap is provided adjacent to the seal.

Preferably, the positioning means is in the form of a sleeve that is axially slideable on the mandrel. The sleeve may have a flange that extends radially outwardly between the primary and backup seals.

In a particularly advantageous form of the invention, the mandrel includes a portion of reduced diameter in which the seal combination can be disposed. The backup seal encircles the sleeve and is confined axially between the flange of the sleeve and an abutment defined by the mandrel at one end of the reduced diameter portion.

It is most advantageous to employ two seal combinations of this construction, with the working fluid being supplied through a passage within the mandrel opening at one or more locations between the seal combinations.

The seal combination that is inserted first is referred to as the inner combination, while the other seal member is referred to as the outer combination.

Another aspect of the invention relates to the use of ramps that permit the primary seals to expand and contract radially while moving axially. The ramps can be so arranged that they taper radially inwardly toward each other. This arrangment permits the primary seals to be contracted for purposes of insertion of the mandrel.

The insertion of the mandrel in the tube tends to force the primary seal of the inner seal combination to move toward the small end of the corresponding ramp so that its diameter is reduced and frictional interference with the insertion of the mandrel is minimized. Accordingly, this inner seal combination does not require any arrangement for biasing the primary seal toward the larger end of the ramp and the primary seal member is freely movable except for frictional forces. The primary inner seal should, however, be so constructed that when it is disposed at the smaller end of the ramp, it has a sufficient diameter to lightly engage the interior surface of the tube. Hydraulic fluid then will not flow past the primary seal but will instead force it to move up the ramp into tighter engagement with the tube as the pressure increases.

In the case of the outer seal member, the ramp is so arranged that its smaller end is inserted in the tube first. The corresponding primary seal is, therefore, urged toward the larger end of the ramp and will tend to bind against the inner surface of the tube as in previously known mandrel construction. To overcome this difficulty, positioning means can be used to resiliently urge the outer primary seal toward the smaller end of the outer ramp. Like the primary inner seal, it still contacts the interior tube surface. When fluid pressure is applied, after insertion, the seal member moves back up the ramp to more tightly engage the inner surface of the tube.

A preferred arrangement for urging the primary outer seal toward the smaller end of the outer ramp employs a spring that surrounds the mandrel and acts on the seal through the sleeve. The spring may be a coil spring disposed within an annular cavity surrounding the mandrel and defined by a cut-away portion of the sleeve.

Other features and advantages of the present invention will become apparent from the following detailed description taken in conjunction with the accompanying drawings, which illustrate, by way of example, the principles of the invention.

DESCRIPTION OF THE PREFERRED EMBODIMENT

Figure 2:
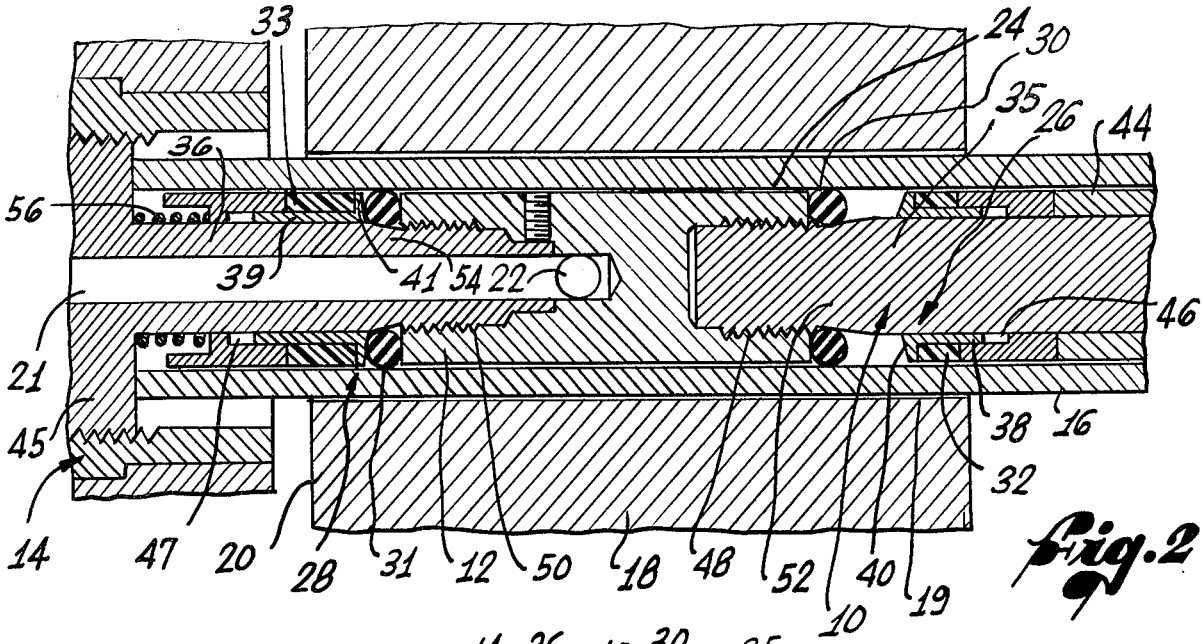
FIG. 2 is an enlarged, longitudinal, cross-sectional view of a mandrel and two seal combinations in accordance with the present invention.
Figure 1:
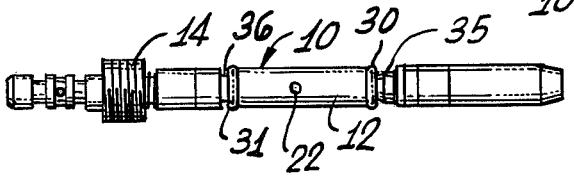
FIG. 1 is a plan view of a mandrel constructed in accordance with the present invention.
Figure 3:
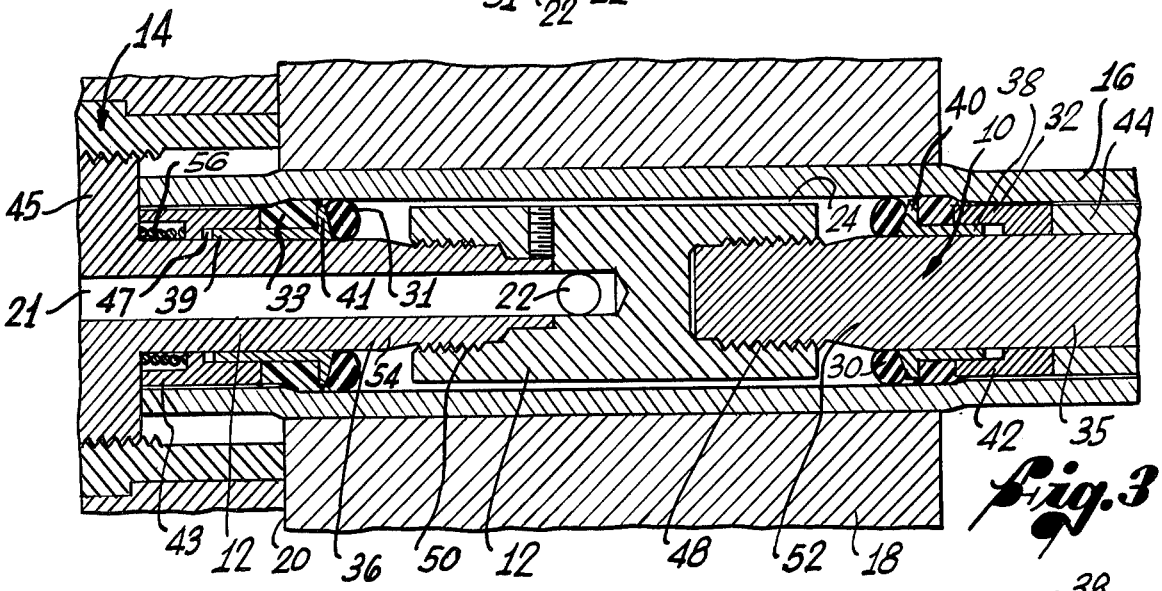
FIG. 3 is a similar longitudinal, cross-sectional view showing the mandrel after it has been fully inserted in the tube and hydraulic pressure has been applied.
Figure 4:
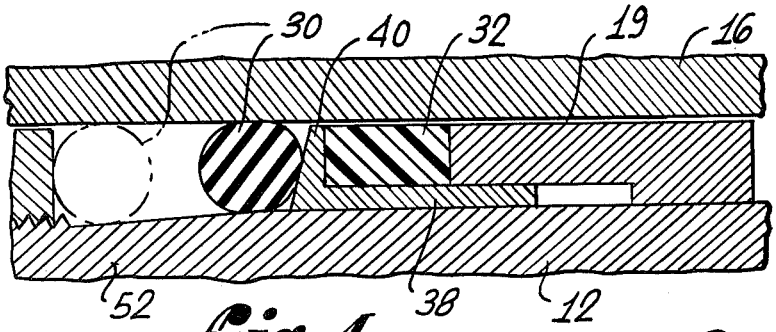
FIG. 4 is a further enlarged fragmentary cross-sectional view showing the inner seal member in solid lines in its operational position and in phantom lines in its insertion position.

A mandrel 10, best shown in FIG. 1 of the accompanying drawings, includes an elongated generally cylindrical body 12 that extends from a head 14. The body 12 is inserted in a tube 16 that is in turn positioned in a bore in a tube sheet 18, as shown in FIGS. 2, 3 and 4.

Although the mandrel 10 fits closely within the tube 16, there is a small annular space 19 between the mandrel and the interior surface of the tube. In the drawings, this annular space 19 is not shown to scale but is exaggerated for purposes of illustration. Once the mandrel 10 is fully inserted so that the mandrel head 14 engages the primary surface 20 of the tube sheet 18, a pressurized hydraulic working fluid, preferably water, is supplied from the head 14 through an axial passageway 21 in the mandrel body 12 that is continued by a cross-bore 22, permitting the fluid to enter an elongated annular volume 24 that is an axial segment of the space 19 between the mandrel body 12 and the tube 16. The boundaries of this volume 24 are defined at opposite ends by an inner seal combination 26 and an outer seal combination 28 by which the working fluid is confined.

Each seal combination 26, 28 consists of an O-ring 30, 31 on the high pressure side and a backup member 32, 33 on the low pressure side. The backup member 32, 33 which is cylindrical, is preferably formed of elastically deformable polyurethane which has the desired memory characteristics. At very high pressures, such as 30,000 psi, it behaves as a liquid. However, there are limits beyond which the backup members 32 and 33 will deform plastically, thus destroying or reducing the effectiveness of the seal combinations 26 and 28 when used again in another tube. It should be noted that the backup seals 32 and 33 can deform plastically into the annular space 19 on the low pressure sides of the seals and this portion of the space immediately adjacent to the seals is accordingly known as an extrusion gap. The existance of an extrusion gap is to be anticipated because of dimentional variations in the tube 16 and because the mandrel body 12 must slide freely into the tube.

Plastic deformation of the backup members 32 and 33 is most problematic when the mandrel body 12 has moved off center in the tube 16, producing a crescent-shaped extrusion gap (not shown). On one side of the mandrel body 12, the gap then has twice the thickness that it would have if the mandrel 10 were centered. When the pressurized working fluid is applied through the passageway 21, the backup seals 32 and 33 may well extrude into the enlarged portion of the gap and deform. A permanent or plastic deformation could result since the elastic limits of the material could be exceeded.

To avoid damage to the backup seals 32 and 33, a positioning mechanism is provided that keeps the mandrel body 12 centered within the tube 16. Thus the mandrel body 12 has two groove-like portions 35 and 36 of reduced diameter, these portions being disposed on opposite sides of the cross bore 22. The seal combinations 26 and 28 are located on opposite sides of these reduced diameter portions 35 and 36. Cylindrical positioning sleeves 38 and 39 that slide axially on the reduced diameter portion 34 and 36 are encircled by the corresponding backup seal 32 and 33 respectively.

On the high pressure end of each sleeve 38, 39 is a flange 40, 41 that extends radially outwardly between the corresponding backup seal 32, 33 and O-ring 30, 31.

Figure 5:
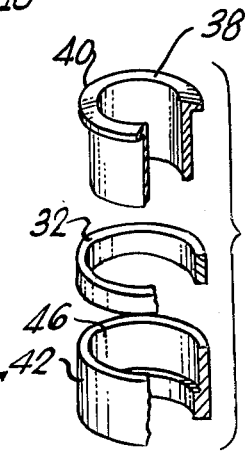
FIG. 5 is an expanded perspective view of a portion of the mandrel structure and the back-up member and sleeve of the seal from FIGS. 4 and 5, parts of the components being broken away to expose their cross-sectional configuration.

Each backup seal 32, 33 is axially confined between the corresponding flange 40, 41 and a stop member 42, 43 disposed between the backup seal 32, 33 and an abutment portion 44, 45 of the mandrel 10 at the end of the reduced diameter portion 35 or 36, respectively. Each stop member 42, 43 is undercut to provide an annular space 46, 47 into which the corresponding sleeve 38 or 39 can move axially away from the adjacent O-ring 30 or 31 (See FIG. 5 in particular with respect to the inner seal combination 26). It will be noted that while the sleeves 38 and 39 can move axially on the mandrel 10, they cannot be cocked, i.e., move angularly, with respect to the mandrel because of their close sliding fit. The mandrel 10 is disassembleable at two threaded joints 48 and 50 so that the back-up members 32 and 33 and the sleeves 38 and 39 can be installed.

Adjacent to each of the reduced diameter portions 35 and 36 is an inwardly tapered conical ramp section 52, 54. The inner seal combination 26 and the corresponding inner ramp 52 will be considered first. This inner ramp 52 is tapered so that its diameter decreases in the direction of the outer seal combination 28 and the mandrel head 14. The inner O-ring seal 30 is freely movable on the ramp 52, except for frictional forces, and the inner backup seal 32 and sleeve 38 are free to slide behind it.

As the mandrel 10 is inserted in the tube 16, frictional engagement of the inner O-ring 30 with the interior surface of the tube 16 pushes the inner O-ring downwardly along the ramp 52 toward the mandrel head 14 to the position shown in FIG. 2. This frictional force will retain the O-ring 30 at the smaller end of the ramp 52 (as shown in FIG. 2 and in phantom lines in FIG. 4) until the mandrel 10 has been fully inserted in the tube 16.

At the opposite end of the volume 24 within which the working fluid is confined, an additional problem is created during the initial insertion of the mandrel 10 due to the interaction of the outer O-ring seal 33 with its corresponding outer ramp 54. The diameter of this outer ramp 54 decreases in a direction proceeding away from the mandrel head 14. Accordingly, when the mandrel 10 is inserted in the tube 16, the frictional forces developed between the outer O-ring 31 and the interior surface of the tube tend to force the O-ring toward the larger end of the ramp 54, resulting in frictional interference with the insertion of the mandrel.

Before turning to the manner in which this problem is overcome, it should be noted that the outer O-ring seal 33, like the inner O-ring 32, encircles a corresponding positioning sleeve 38. The stop member 43 disposed on the opposite side of the outer backup member 33 from the outer O-ring 31 is undercut from both ends. On the inner end the undercut receives the sleeve 39, whereas the undercut at the outer end defines an annular spring cavity that receives a coil spring 56 surrounding the mandrel body 12. The stop member 43 is slidable on the mandrel body 12 and is urged away from the mandrel head 14 by the positioning spring 56. When the mandrel 10 is being inserted in the tube 16, the force of the spring 56 is sufficient to overcome the frictional force acting on the outer O-ring 31 and to retain that O-ring at the smaller end of the outer ramp 54.

The O-rings 30 and 31 are both so dimensioned that when disposed at the smaller ends of the ramps 52 and 54, their outside diameter is large enough to lightly engage the interior surface of the tube 16, as best shown with respect to the inner O-ring in phantom lines in FIG. 4. Thus, when hydraulic fluid enters the annular volume 24, it cannot readily pass the inner O-ring seals 30 and 31. Hydraulic pressure forces the O-rings 30 and 31 up the ramps 52 and 54 until they reach the untapered reduced diameter portions 44 and 46 of the mandrel body 12 where they come to rest, as shown in FIG. 3 and in solid lines in FIG. 4.

The inner backup seal 32 is then axially confined between the inner O-ring 30 and the inner stop member 45, with the flange 40 of the inner sleeve 38 protruding between the O-ring and the backup seal. The pressurized working fluid pushes the inner O-ring 30 away from the mandrel head 14, thus pushing the inner sleeve 38 axially along the mandrel body 12 into the annular space 46. The inner backup seal 32 is thus compressed between the flange 40 and the abutment 44 and caused to expand radially as the tube 16 expands under the pressure of the working fluid as shown in FIG. 3. Since the sleeve 38 can move only axially, the flange 40 must apply an equally distributed axially compressive force about the entire circumference of the backup seal 32. Therefore, the radial expansion of the backup seal 32 will be substantially equal about its entire circumference.

Even if the mandrel 10 is not properly centered within the tube 16 at the time the hydraulic pressure is initially applied, it is forced to assume a radially centered position defining a substantially uniform extrusion gap 34 due to the uniform radial expansion of the backup seal 32. Accordingly, a substantial asymmetrical configuration of the backup seal 32 resulting in a plastic deformation due to a crescent-shaped extrusion gap is rendered impossible. When the extrusion gap is of a uniform dimension, the maximum gap width to which the backup seal 32 is exposed is only half that which can be encountered in prior art sealing devices in which the backup seal can be cocked and the mandrel body 12 moved off center.

As in the case of the inner O-ring 30, the outer O-ring 31 has a large enough outside diameter that it still lightly engages the interior surface of the tube 16 when at the small end of the outer ramp 15. Thus, when hydraulic fluid is introduced to the annular volume 24, it cannot pass the outer O-ring 31. Instead, it overcomes the force of the spring 56 and moves the outer O-ring 31 axially along the mandrel body 12 to the larger end of the outer ramp 54. The outer O-ring 31 then forms a tight leak-proof seal against the tube 16 and transmits the force of the hydraulic fluid to the outer backup seal 33. The outer sleeve 39 interacts with the outer backup seal 33 in the same manner as in the inner seal combination 26, keeping the backup member centered in the tube 16. The result is that the working fluid is confined within the pressure zone and the tube 16 is expanded radially between the far ends of the backup seals 32 and 33 as shown in FIG. 3. It should be noted that the outer sleeve 39 and the spring 56 perform two functions. Firstly, they retain the outer O-ring 31 at the small end of the outer ramp 54 during insertion, and secondly, they center the outer backup seal 33 during tube expansion.

It will be understood, in light of the foregoing, that the present invention provides a unique and improved mandrel which can be readily inserted in a tube without the need to overcome large frictional forces. Nevertheless, the effectiveness of the seals in containing the hydraulic fluid is not diminished. It will also be found that plastic deformation of the backup member 38 will not occur in the case of the present invention under circumstances that would result in such deformation if the extrusion gap were asymmetrical.

While a particular form of the invention has been illustrated and described, it will be apparent that various modifications can be made without departing from the spirit and scope of the invention.

I claim:

1. A swaging apparatus for expanding a tube radially by the internal hydraulic pressure of a working fluid, said apparatus comprising:

a mandrel to be positioned axially within said tube;

seal means for confining said working fluid between said mandrel and said tube, said seal means including at least one seal member encircling said mandrel to be compressed axially and expanded radially upon the application of pressure thereto by said working fluid;

a ramp defined by said mandrel and tapered radially inwardly from a large end to a small end, said ramp being positioned so that said seal member can move between an insertion position at said small end of said ramp and a sealing position at said large end of said ramp; and positioning means for preventing angular movement of said seal means relative to the longitudinal axis of said mandrel when said hydraulic pressure is applied and for urging said seal member toward said small end of said ramp when said apparatus is being inserted.

2. The apparatus of claim 1 wherein said mandrel has a passage therein through which said working fluid can be introduced into said tube.

3. The apparatus of claim 1 wherein said positioning means is axially slidable on said mandrel.

4. The apparatus of claim 1 wherein:

said positioning means comprises a sleeve that is axially slidable on said mandrel; and said seal member encircles said sleeve.

5. The apparatus of claim 4 wherein said sleeve has a radially outwardly extending flange thereon that engages said seal member.

6. The apparatus of claim 4 further comprising resilient means for urging said sleeve toward said small end of said ramp and thereby urging said seal member toward said insertion position.

7. The apparatus of claim 6 wherein said resilient means is a sping.

8. The apparatus of claim 1 wherein said sleeve has a cut-away portion that defines an annular spring cavity and said resilient means is a coil spring disposed within said cavity.

9. A swaging apparatus for expanding a tube radially by the internal hydraulic pressure of a working fluid, said apparatus comprising:

a mandrel to be positioned axially within said tube;

a primary seal and a backup seal, said seals encircling said mandrel to be compressed axially and expanded radially against said tube upon the application of pressure thereto by said working fluid, said primary seal being relatively soft compared to said backup seal;

a ramp defined by said mandrel and tapered radially inwardly from a large end to a small end, said ramp being positioned so that said primary seal can move between an insertion position at said small end of said ramp and a sealing position at said large end of said ramp; and positioning means for preventing angular movement of said backup seal relative to the longitudinal axis of said mandrel, thereby forcing said backup seal and said mandrel to assume a radially centered position within said tube as it expands radially, thus defining a substantially uniform circumferential extrusion gap adjacent said backup seal.

10. The apparatus of claim 9 wherein said mandrel has a passage therein through which said working fluid can be introduced into said tube.

11. The apparatus of claim 9 wherein said positioning means is axially slidable on said mandrel.

12. The apparatus of claim 9 wherein said primary seal is an O-ring.

13. The apparatus of claim 9 wherein said backup seal is made of polyurethane.

14. The apparatus of claim 9 wherein said positioning means comprises a sleeve that is axially slidable on said mandrel, said sleeve having a flange that extends radially outwardly and said backup seal being confined axially by said flange.

15. The apparatus of claim 14 wherein said backup seal encircles said sleeve.

16. The apparatus of claim 15 wherein said primary seal is an O-ring and said backup seal member is made of polyurethane.

17. The apparatus of claim 16 further comprising an abutment defined by said mandrel, said backup seal being disposed between said abutment and said flange.

18. The apparatus of claim 14 further comprising resilient means for urging said sleeve toward said small end of said ramp and thereby urging said primary seal toward said insertion position.

19. The apparatus of claim 18 wherein said resilient means is a spring.

20. The apparatus of claim 18 wherein said sleeve has a cut-away portion that defines an annular spring cavity and said resilient means is a coil spring disposed within said cavity.

21. The apparatus of claim 9 wherein said positioning means includes a sleeve that is axially slidable on said mandrel and encircled by said backup seal.

22. A swaging apparatus for expanding a tube radially by the internal pressure of a working fluid, said apparatus comprising:

a mandrel to be positioned axially within said tube;

a softer primary seal and a harder but elastically deformable backup seal surrounding said mandrel to be compressed axially and expanded radially upon the application of pressure thereto by said working fluid;

a ramp defined by said mandrel and tapered radially inwardly from a large end to a small end, said ramp being positioned so that said primary seal can move axially within said tube between an insertion position at said small end of said ramp and a sealing position at said large end of said ramp; and positioning means for preventing angular movement of said backup seal relative to the longitudinal axis of said mandrel when said hydraulic pressure is applied and for urging said primary seal toward said small end of said ramp when said apparatus is being inserted, said positioning means including a sleeve axially slidable on said mandrel and a spring arranged to urge said sleeve toward said small end of said ramp.

23. The apparatus of claim 22 wherein said sleeve has a cut-away portion that defines an annular spring cavity and said spring is a coil spring disposed within said cavity and encircling said mandrel.

24. The apparatus of claim 22 wherein said backup seal is made of polyurethane.

25. The apparatus of claim 22 wherein said primary seal is an O-ring.

26. A swaging apparatus for expanding a tube radially by the internal hydraulic pressure of a working fluid, said apparatus comprising:

an elongated mandrel to be inserted in said tube;

inner and outer seal combinations encircling said mandrel at axially spaced-apart locations, each of said seal combinations comprising a relatively soft primary seal and a relatively hard but elastically deformable backup member, said seal combinations defining the boundaries of an annular volume between said mandrel and said tube;

a passage extending through said mandrel to supply said working fluid to said annular volume;

an outer ramp defined by said mandrel and tapered radially inwardly toward said inner seal combination, said outer ramp being adapted to permit said primary seal of said outer seal combination to move axially therealong toward said inner seal combination, thereby reducing frictional forces resulting from the engagement of said primary seal of said outer seal combination with said tube as said mandrel is inserted;

outer positioning means for preventing angular movement of said backup seal of said outer seal combination relative to the longitudinal axis of said mandrel and for urging said primary seal of said outer seal combination toward the small end of said outer ramp when said apparatus is being inserted in said tube;

an inner ramp defined by said mandrel and tapered radially inwardly toward said outer seal combination, said inner ramp being adapted to permit said primary seal of said inner seal combination to move axially therealong toward said outer seal combination, thereby reducing frictional forces resulting from the engagement of said primary seal of said inner seal combination with said tube as said mandrel is inserted; and inner positioning means for preventing angular movement of said backup seal of said inner seal combination relative to the longitudinal axis of said mandrel.

27. The apparatus of claim 26 wherein said inner and outer positioning means each include a sleeve that is axially slidable on said mandrel, said sleeves being encircled by said backup seals.

28. The apparatus of claim 27 wherein each of said sleeves carries a flange disposed between the primary and backup seals of the corresponding one of said seal combinations.

29. The apparatus of claim 26 wherein said primary seals are O-rings.

30. The apparatus of claim 26 wherein said primary seals are O-rings and said backup seals are made of polyurethane.

31. The apparatus of claim 26 wherein said primary seal of said inner seal combination is axially movable on said inner ramp, restrained only by frictional forces.

32. The apparatus of claim 26 wherein:

said mandrel is generally cylindrical;

said inner and outer seals encircle said body; and said ramps are conical.

* * * * *